United States Patent [19]

Fränkel

[11] Patent Number: 5,029,754

[45] Date of Patent: Jul. 9, 1991

[54] SAFETY DEVICE FOR REMOVING OR INSERTING A CARRIAGE WITHIN A GUIDE RAIL

[75] Inventor: Manfred Fränkel, Hof

[73] Assignee: Söll Industrieschmiede GmbH, Hof/Bayern, Fed. Rep. of Germany

[21] Appl. No.: 522,006

[22] Filed: May 10, 1990

[30] Foreign Application Priority Data

May 10, 1989 [DE] Fed. Rep. of Germany ... 8905853[U]

[51] Int. Cl.[5] ..... E06C 7/18

[52] U.S. Cl. ..... 238/166; 104/118; 104/130

[58] Field of Search ..... 238/88, 89, 91, 121, 238/122, 151, 164–166, 198; 104/130, 131, 132, 91, 262–264, 268, 271, 242, 245, 246, 118, 119, 307

[56] References Cited

U.S. PATENT DOCUMENTS

| | | | |
|---|---|---|---|
| 1,072,273 | 9/1913 | Thull | 258/166 |
| 1,267,279 | 5/1918 | Scalpelli | 238/166 |
| 3,013,504 | 12/1961 | Schütze | 104/120 X |
| 3,093,090 | 6/1963 | Rosenbaum | 104/118 X |
| 3,377,960 | 4/1968 | Hawes | 104/118 |
| 3,782,292 | 1/1974 | Metcalf | 104/130 |
| 4,152,992 | 5/1979 | Mackintosh | 104/118 X |
| 4,389,942 | 6/1983 | Düll et al. | 104/130 X |
| 4,655,141 | 4/1987 | Gillson | 104/307 |
| 4,840,123 | 6/1989 | Osthus et al. | 104/130 X |
| 4,926,753 | 5/1990 | Weiss | 104/118 X |

FOREIGN PATENT DOCUMENTS

| | | | |
|---|---|---|---|
| 2919894 | 11/1980 | Fed. Rep. of Germany | 194/307 |
| 8811779 | 12/1988 | Fed. Rep. of Germany . | |

*Primary Examiner*—Frank E. Werner
*Assistant Examiner*—Brian K. Dinicola
*Attorney, Agent, or Firm*—Hoffmann & Baron

[57] ABSTRACT

A safety device is provided which includes a guide rail having a C-shaped profile wherein a carriage can be inserted in or removed from the guide rail. The guide rail includes a piece of rail with the same profile as the guide rail that is laterally pivotable about an axis. The piece of rail can pivot to both a closed position where it is aligned with the guide rail, and an open position wherein a carriage may be inserted therein. The axis is located beneath the center of the piece of rail so that a carriage can be inserted in, or removed from the piece of rail only from the top and cannot drop out the bottom. The piece of rail's laterally pivotable motion is limited to the minimum required for inserting a carriage into the piece of rail. A locking plate is displaceably mounted within the guide rail. The locking plate is displaceable between a locking position and a release position. It engages the piece of rail and one of the opposing ends of the guide rail when in the locking position and is fully retracted within one of the opposing ends of the guide rail when in the release position.

2 Claims, 2 Drawing Sheets

SAFETY DEVICE FOR REMOVING OR INSERTING A CARRIAGE WITHIN A GUIDE RAIL

BACKGROUND OF THE INVENTION

The present invention relates to the art of safety devices and; in particular, to a device for removing a safety catch from or setting it into a safety apparatus guide rail.

An exit device is known from German Utility Model No. 88 11 779, in which a lateral cheek, (i.e. side portion) of a C-profile, (i.e. a section having a C-shaped cross-section) of the guide rail is cut out over a length. The length is somewhat greater than the length of the carriage, and replaced by a pivotable flap. In the closed position of the flap, the carriage is also guided within the cut-out portion of the cheek. In the open position of the flap, guiding of the carriage within the cut-out portion is interrupted, and at this location the carriage can be set into the guide rail or be removed from it. In order to avoid accidents, it is necessary to make sure that the flap is in the closed position after the removal or setting in of a carriage. Otherwise, the carriage of a user next in line could drop unintentionally out of the guide rail.

Furthermore, switch points in the form of rotatable discs are known in the case of climbing guards, which make it possible to change the direction of movement, for instance, from the vertical to the horizontal or at an angle to the vertical. The rotatable disc includes a short piece of the guide rail, which is rotatable about an axis of rotation passing through the center of the piece of guide rail and extending from the front to the back. When the branching guide rail is omitted, such a rotatable disc may also be utilized for removing and setting in the carriage. There always exists the danger in that regard, however, that the carriage will fall to the side out of the guide rail by spontaneous turning of the rotatable disc.

It is therefore an object of the present invention to eliminate accidental dropping of the carriage out of the guide rail.

SUMMARY OF THE INVENTION

This problem is solved, according to the invention, by the pivoting range of a piece of rail being limited by a stop means. The stop means allows a pivoting range limited to the minimum required for being able to set a carriage into the rail piece. Also, the axis of rotation lies further from a carriage removal end than from its opposite end, so that the carriage can be removed or set in, respectively, only towards or from, respectively, the carriage removal end and cannot drop out the opposite end from the carriage removal end.

In order to remove the carriage from the guide rail, the carriage is at first pushed into the pivotable piece of rail. Thereupon, the piece of rail is pivoted, so that it is disposed at an angle relative to the guide rail and the carriage can be pulled laterally out of the piece of rail. In order to set the carriage into the guide rail, the piece of rail is at first pivoted, so that the carriage can be pushed into the piece of rail. Thereupon, the piece of rail is turned into the closed position, in which it is in alignment with the guide rail, so that the carriage can be pushed out of the piece of rail and into the guide rail. While the two ends of the guide rail that are adjacent to the piece of rail are free in the pivoted, open position of the device, a carriage can, however, be moved only partially out of these open ends until it abuts the pivoted piece of rail because the pivoted piece of rail is attached between these two ends. That makes any unintentional dropping of the carriage out of the guide rail impossible. For the piece of rail to be able to receive the carriage, it must be at least as long as the carriage.

The range of the pivoting movement of the piece of rail is limited such that when the piece of rail is in the pivoted position, the carriage is just able to be set into the piece of rail or be removed therefrom. This provides the advantage that a carriage can move only slightly out of an end of the guide rail until it abuts the pivoted piece of rail.

The piece of rail preferably is adapted to be locked in place in the closed position, i.e. in the position in which it is in alignment with the guide rail. For that purpose, a locking plate is arranged within the one end of the guide rail in a manner to be displaceable from a locking position into a release position. The locking plate in the locking position is in engagement with the piece of rail and the end of the guide rail adjacent to it and in the release position is completely retracted into the guide rail, so that it is out of engagement with the piece of rail.

As a result of the present invention, the carriage cannot accidentally drop out of the guide rail. Thereby, the present invention eliminates the consequences that may occur as a result of such an accident.

A preferred form of the device, as well as objects, features and advantages of this invention will be apparent from the following detailed description of an illustrative embodiment thereof, which is to be read in connection with the accompanying drawings.

DETAILED DESCRIPTION OF THE PREFERRED EMBODIMENT

Figure 1:
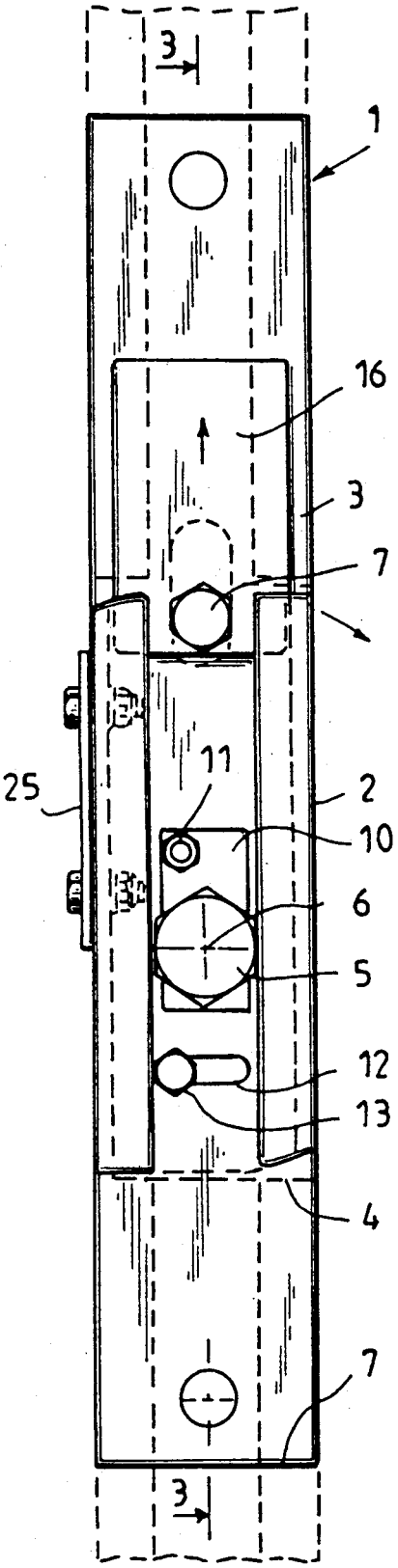
FIG. 1 is a front elevation view of an exit device in a closed position.

FIG. 1 shows in dotted lines a guide rail 1, which is interrupted by an exit device that is located between the two ends 3 and 4 of the guide rail. The exit device includes a piece of rail, which is mounted for rotation about an axis 6 of rotation on a connecting rail 7, which has a C-profile and is overlapping with the ends 3, 4 of the guide rail 1 and is connected to them. The piece 2 of the rail has the same profile as the guide rail 1 and, in the closed position, is precisely in alignment with the guide rail 1, so that a carriage of a safety apparatus can slide smoothly from one end 3 over the piece 2 of the rail and into the other end 4 of guide rail 1.

Figure 3:
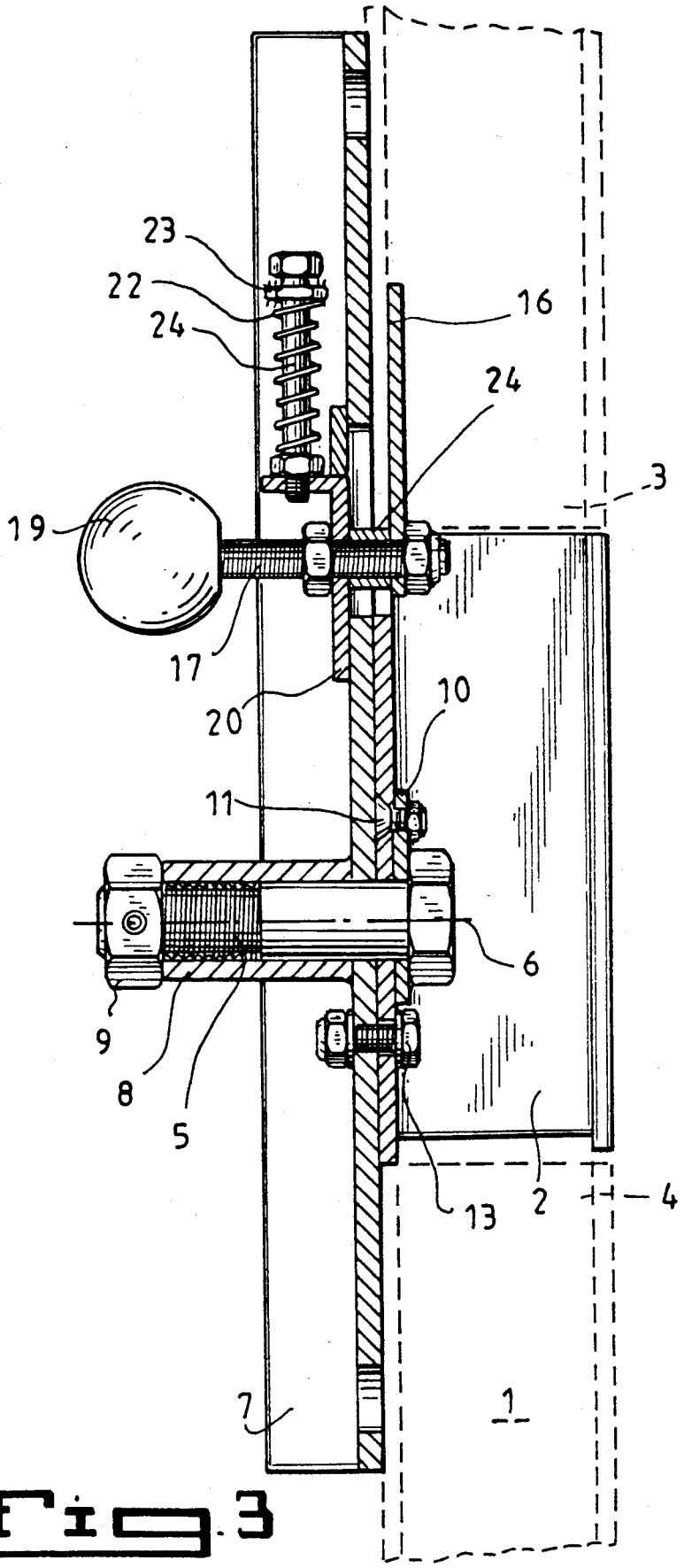
FIG. 3 is a sectional view of the exit device taken along line 3—3 of FIG. 1.

The axis of rotation 6 of piece 2 of the rail expediently extends from the rear forwardly, i.e. normal to the back side of the guide rail 1 or piece 2 of the rail. FIG. 3 shows the mounting means which includes a bushing 8, which extends from the connecting rail 7 rearwardly, and of a large-size screw 5, which passes through piece 2 of the rail and the connecting rail 7 in the pivot point and is secured on the rearward end of bushing 8 means of a nut 9 with a tensioning pin. The hexagon head of screw 5 is securely welded onto a small plate 10, which is in turn fastened to the base of piece 2 of the rail by means of a countersunk screw 11 and a nut. Since the piece 2 of rail consists, as is usual, of aluminum, the steel screw 5 cannot be welded directly onto piece 2 of the rail. The pivoting range of piece 2 of the rail is limited by means of a stop pin 13, which is disposed beneath axis of rotation 6 in the connecting rail 7 and sliding within an elongated hole 12 in the base of piece 2 of the rail. This is in a manner such that piece 2 of the rail can be pivoted in a clockwise direction only, and only to an extent such that left-hand cheek 14 (i.e. side) of piece 2 of the rail lies near the right-hand cheek 15 of the end 3 of the guide rail 1 and, hence, the carriage can just be pulled upwardly out of piece 2 of the rail. Since the axis 6 of rotation lies somewhat further from a carriage removal end of piece 2 of the rail, than its opposite end and, hence, the carriage removal end of piece 2 of the rail is pivoted to a greater extent than the end opposite from the carriage removal end, the carriage can only be removed towards the carriage removal end and can set in only from the carriage removal end. This is expedient, so that a carriage set in from the carriage removal end cannot immediately drop out the opposite end from the carriage removal end of piece 2 of the rail.

Figure 2:
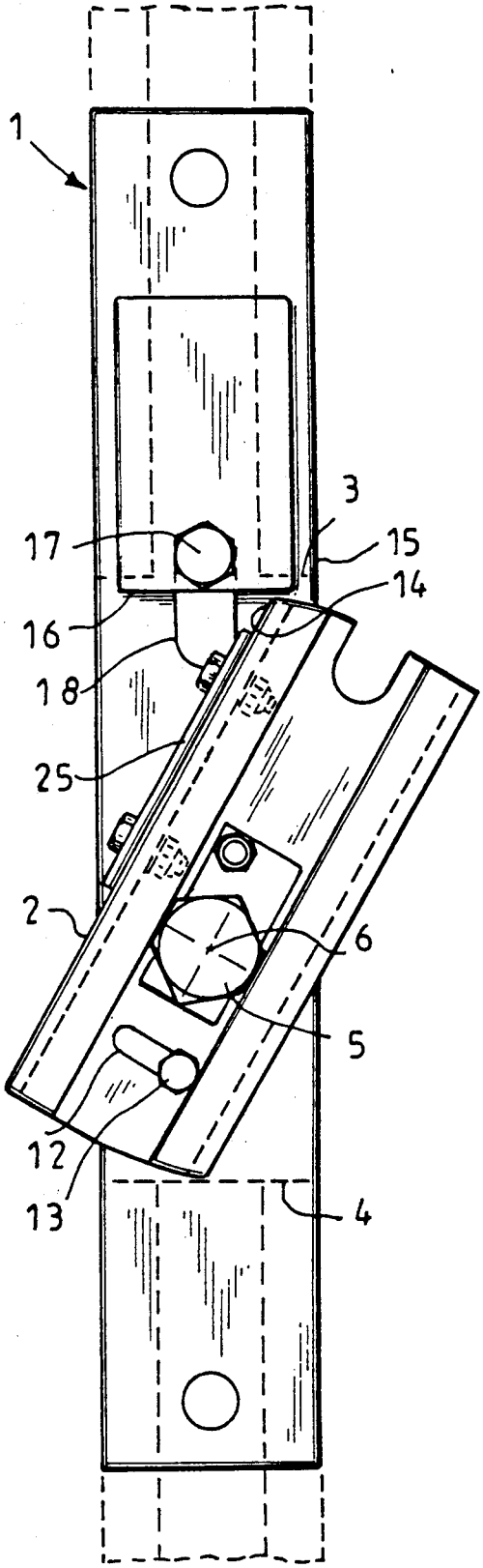
FIG. 2 is a front elevation view of the exit device in an opened, pivoted position.

As may be seen at once from looking at FIG. 2, a carriage cannot fall out of the upper end 3 of the guide rail 1, nor, by the same token can a carriage be lifted out of the lower end 4 of the guide rail 1, when piece 2 of the rail has been pivoted, i.e. when the exit device is open, because the interior of the ends 3 and 4 of the guide rail 1 is in part blocked by the obliquely disposed piece 2 of rail. There hence exists no danger that a carriage at the exit device will accidentally drop out of guide rail 1.

At the upper end 3 of guide rail 1 there is disposed a locking device, which includes a locking plate 16, which in the unlocked position is slid fully into the upper end 3 and in the locked position is slid in part into the inside of piece 2 of the rail. This is so that the exit device is secured in the closed position, in which it is in alignment with guide rail 1. A threaded rod 17 extends from the locking plate 16 through an elongated hole 18 of the connecting rail 7 to the back, and a ball head 19 (in FIG. 3) is screw-attached to the rearward end of the threaded rod 17. Piece 2 of the rail is likewise cut out to the extent to which piece 2 of the rail overlaps with the elongated hole 18 in the closed position of the exit device. Furthermore, a slider 20 (in FIG. 3) is attached to the threaded rod 17 on the back side of the connecting rail 7. The slider is maintained by a threaded bushing 21 at a spacing from the locking plate 16, which (spacing) corresponds to the sum total of the material thickness of the connecting rail 7 and of piece 2 of the rail. A helical compression spring 22, which is supported on a support plate 23 on the connecting rail 7 and urges the locking plate 16 into the locking position, engages an angle flange of the slider 20. The helical spring 22 is guided through a screw 24, which extends through bores of the angle flange and of the support plate 23.

A metal safety sheet 25 projecting forward is screw-attached to the left-hand cheek 14 of piece 2 of the rail. The metal sheet prevents, in cooperation with a pin projecting to the right on the carriage in a known manner, the carriage being placed in incorrect orientation into piece 2 of the rail.

While there has been described what is at present considered to be the preferred embodiment of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A safety device comprising:

a guide rail having a C-shaped profile and a pair of opposing ends; and means for inserting a carriage within or removing a carriage from said guide rail comprising a piece of rail positioned between said opposing ends, said piece of rail having the same profile as said guide rail and including a carriage removal end and an opposite end; means for pivotably mounting said piece of rail such that said piece of rail is laterally pivotable about an axis between a closed position wherein said piece of rail is aligned with said guide rail and an open position wherein a carriage may be inserted therein, said axis being located further from said carriage removal end than from said opposite end so that a carriage can be inserted in or removed from said piece of rail only from said carriage removal end and cannot drop out from said opposite end thereof; and means for limiting the extent to which said piece of rail is laterally pivotable about said axis to substantially the minimum that is required for inserting a carriage into said piece of rail.

2. An apparatus as described in claim 1 including a locking plate displaceably mounted within said guide rail, said locking plate being displaceable between a locking position and a release position, said locking plate engaging said piece of rail and one of said opposing ends of said guide rail when in the locking position, and being fully retracted within said one of said opposing ends of said guide rail when in the release position.

* * * * *